US006305654B1

(12) United States Patent
Schmidt et al.

(10) Patent No.: US 6,305,654 B1
(45) Date of Patent: Oct. 23, 2001

(54) CLAMPING HOLDER

(75) Inventors: Axel Schmidt, Wedemark; Gerd Soehnholz, Essel, both of (DE)

(73) Assignee: Sennheiser electric GmbH & Co. KG, Wedemark (DE)

( * ) Notice: Subject to any disclaimer, the term of this patent is extended or adjusted under 35 U.S.C. 154(b) by 0 days.

(21) Appl. No.: 09/483,232

(22) Filed: Jan. 14, 2000

(30) Foreign Application Priority Data

Jan. 15, 1999 (DE) ..... 299 00 579 U

(51) Int. Cl.[7] ..... A47B 96/06

(52) U.S. Cl. ..... 248/231.61; 248/229.24; 248/443

(58) Field of Search ..... 248/231.61, 231.51, 248/229.24, 230.5, 443, 447.2, 316.1, 316.7, 220.22, 229.13, 229.23, 230.4, 316.5; 84/453, 723; 381/365; 24/514, 525

(56) References Cited

U.S. PATENT DOCUMENTS 1,669,523 * 5/1928 Isecoff ..... 248/229.15
2,212,156 * 8/1940 Erdley ..... 248/229.13
2,749,073 * 6/1956 Guysi et al. ..... 248/231.41
3,154,279 * 10/1964 Fletcher et al. ..... 248/74.1
3,177,542 * 4/1965 James ..... 24/115 R
3,270,994 * 9/1966 Machan et al. ..... 24/505
3,665,490 * 5/1972 Oskar ..... 381/366
4,505,010 * 3/1985 Arenhold ..... 24/456
4,759,252 * 7/1988 Occhipinti ..... 84/387
4,917,677 * 4/1990 McCarthy ..... 606/151
5,163,643 * 11/1992 Auclair ..... 248/61
5,884,372 * 3/1999 Anscher et al. ..... 24/339
6,149,114 * 11/2000 Epping et al. ..... 248/220.22

FOREIGN PATENT DOCUMENTS

11275671-A * 10/1999 (JP) .

* cited by examiner

*Primary Examiner*—Anita King
*Assistant Examiner*—Naschica Morrison
(74) *Attorney, Agent, or Firm*—Reed Smith LLP

(57) ABSTRACT

A clamping holder comprises an arrangement of a first leg and a second leg which are constructed in such a way that they can be moved towards one another. An adjusting device acts on at least one of the legs. Activation of the adjusting device enables a movement of the legs towards one another so that the objects to be clamped can be locked in position. A device is also provided that cancels the locking effect and that holds the adjusting device at the clamping holder.

7 Claims, 3 Drawing Sheets

CLAMPING HOLDER

BACKGROUND OF THE INVENTION a) Field of the Invention

The invention is directed to a clamping holder with an arrangement of a first leg and a second leg which are formed in such a way that they can be moved towards one another and with adjusting means acting upon at least one of the legs, the activation of these means enabling a movement of the legs towards one another so that objects can be locked in position.

b) Description of the Related Art

Clamping holders of the preceding type are known. They are used, for example, to clamp the arms of instrument microphones to musical instruments. They are constructed, for example, as a holding clip, wherein the adjusting means have a defined spring stiffness (pretensioning) that is determined by material and manufacture and by means of which the legs are pressed together. These known clamping holders are disadvantageous in that the cross section of the material to be clamped is predetermined. Further, if used incorrectly, there is the risk of mechanical damage when engaging parts with delicate surfaces. The object to be clamped can only be axially displaced or rotated while in the clamped state under frictional engagement, which increases mechanical wear.

Clamping holders constructed as holding clips with bore holes in their legs are also known. A first bore hole in one of the legs is threaded. The diameter of a second bore hole in the other of the two legs is slightly greater than the diameter of the first bore hole. The adjusting means of a known clamping holder of this type are formed by an adjusting screw with a continuous thread engaging in the thread of the first bore hole. The adjusting screw is guided through the second bore hole with a small amount of play. A head of the adjusting screw rests on the outside of that leg of the clamping holder provided with the second bore hole.

A clamping holder of this known type is changed from the opened position to the closed position by tightening the adjusting screw. Screwing in the adjusting screw causes the leg provided with the second bore hole to be carried along by the head of the adjusting screw and moved into the closed position. An object which is arranged between the legs for clamping is held by frictional engagement by the clamping holder when the adjusting screw is tightened.

An object which is clamped in this known type of clamping holder is released from the clamping holder by unscrewing the adjusting screw. The movability of the leg with the second bore hole in the intermediate space between the head of the adjusting screw and a position in contact with the leg with the first bore hole is increased corresponding to the releasing rotational movement. Provided the clamping holder has been opened, the object arranged between the legs can be removed from the clamping holder.

In practice it happens, for example, that an object clamped between the legs of a known clamping holder sticks to the legs. In this case, releasing the adjusting screw of a clamping holder holding an object in such a manner will not result in a movement of the leg with the second bore hole. In this situation, a user might suspect that the adjusting screw has not been unscrewed far enough to release the object. However, as a result of further unscrewing of the adjusting screw from the first bore hole, the adjusting screw will lose its hold in the clamping holder and will be released by the clamping holder and, for example, fall to the floor where it can get lost.

There is also the danger that a user of this clamping holder who is possibly in a hurry may not open the legs sufficiently when turning the adjusting screw, so that the surface of the object to be inserted between the legs or to be removed from the holder is damaged by rough contact with the legs. Frequent use of the known clamping holder for clamping an object, particularly if this object has a sensitive surface, can result in damage to the surface of the object by scratching and/or deformation.

There is an additional risk of deformation of an object held by a known clamping holder by the fact that a user may tighten the adjusting screw so much that the object is dented by the legs, for example.

A further disadvantage of the known clamping holders consists in that the object to be held by such a clamping holder can be precisely positioned only with difficulty because the legs of the clamping holder do not hold the object when in the open position so that, when placing between the legs, the object is practically free to move between the legs. Tightening the adjusting screw locks the object firmly between the legs, so that a slight adjustment or turning of the object between the legs can no longer be made as it is now connected with the legs in frictional engagement.

OBJECT AND SUMMARY OF THE INVENTION

It is the primary object of the invention to provide a clamping holder that can be positioned as precisely as possible, that causes a minimum of wear, avoids damaging a delicate surface of the object to be clamped, and has adjusting means permitting easy opening of the clamping holder, wherein the adjusting means are safely fastened to the clamping holder.

This object is met according to the invention for the clamping holder mentioned above through the arrangement of means which cancel the locking effect and hold the adjusting means on the clamping holder.

The invention realizes a clamping holder in which the adjusting means are fastened to the clamping holder on principle. In particular, the clamping holder according to the invention is gentle on the surface of an object to be held between the legs and thus minimizes mechanical wear. An additional advantage of the clamping holder according to the invention lies in the increased user-friendliness and operability compared to known clamping holders.

Insofar as the adjusting means comprise an adjusting screw, the means for canceling the locking of the clamping holder comprise an undercut or groove provided in the adjusting screw. A pressing force exerted by the legs against the object to be clamped is substantially determined by an axial force of the adjusting screw. The adjusting screw engages in at least one thread of the clamping holder so that it is connected with one of the two legs of the clamping holder. The thread is located either in one of the two bore holes or a nut is received at one of the legs, for example, in a recess provided for this purpose in the outside of the leg. Such an arrangement is especially advantageous when the legs of the clamping holder are made of plastic having properties less suitable for a thread than those of metal. The portion having the groove is bigger than the thread so that, within certain limits of the angle of aperture of the legs, the thread is completely overlapped by the groove, the thread function is inactivated and the contact pressing force is minimized. This is due to the fact that the adjusting screw is freely displaceable within the interval of the difference in length between the groove and thickness of the internal thread and can no longer exert any axial forces.

The two legs of the clamping holder are preferably connected with one another in a springing manner at one end, which has the advantage that the orientation of the legs relative to one another is predetermined with the exception of an angle of aperture, which facilitates handling of the clamping holder for the user. Even when the legs are in the open position, an inherent springing force advantageously causes a slight pressing force to be exerted against the surface of the object to be clamped, so that the object to be clamped is engaged to a certain extent before the set screw has been tightened. It is possible for the user to change the way the object to be clamped is positioned between the legs which press against one another slightly. After the object has been definitively positioned between the legs, the user closes the clamping holder firmly by tightening the adjusting screw.

One embodiment form of the clamping holder according to the invention is intended for receiving a microphone arm which, for example, is specifically intended for use with musical instruments. The shape of the legs in the portion intended to receive a microphone preferably corresponds complementarily to the shape of the microphone arm. When the legs of the clamping holder have reached a certain threshold opening angle, the microphone arm to be clamped in snaps in between these legs and engages at the inner sides thereof in a positive engagement and frictional engagement. This has the advantage of evenly distributing the pressing force exerted by the legs over the surfaces of the microphone they are in contact with, so that the risk of scratching the easily abraded surface of the microphone arm or of a coating of the microphone arm, for example, is minimized.

The clamping holder is provided with a device that can be used to fasten the clamping holder to an object, for example, a musical instrument, determined by the user. Preferably, the clamping holder is connected with the fastening device in an adjustable manner so that an orientation of the clamped object, for example, a microphone, can be adjusted relative to a sound source.

An embodiment example of the invention is described in more detail in the following with reference to the drawings.

DESCRIPTION OF THE PREFERRED EMBODIMENTS

Figure 1:
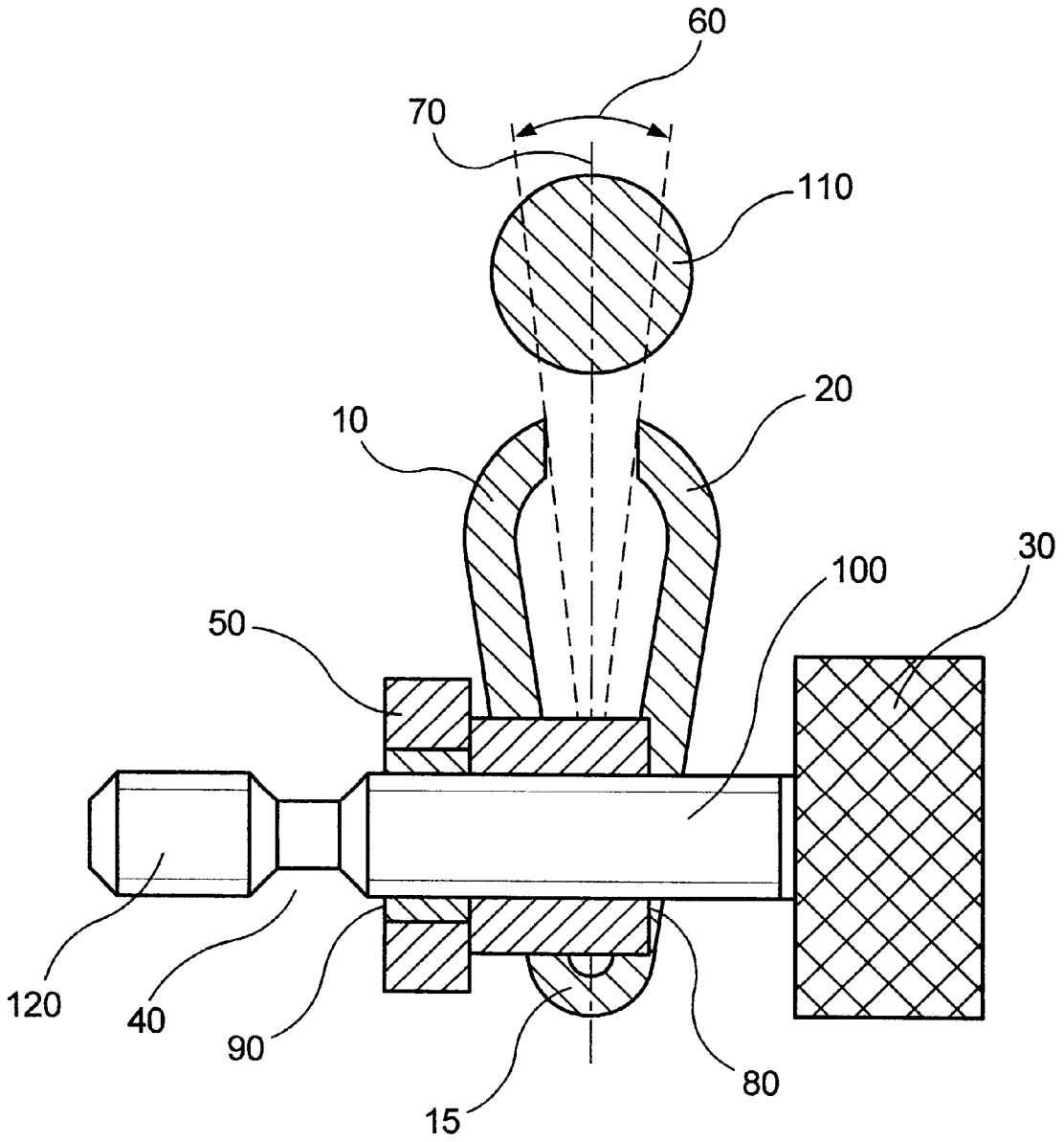
FIG. 1 shows a cross-sectional side view through a first clamping holder.

Two legs 10, 20 of a first clamping holder (FIG. 1) are arranged substantially in a V-shape and connected with one another at one end 15 in such a way that they form portions of the same structural component part of the clamping holder. The legs 10, 20 are in a slightly opened position relative to one another, determining an angle of aperture 60.

A block element 50 is arranged at the legs 10, 20. The block element has a bore hole 80 at right angles to the bisecting line 70 of the angle of aperture 60. Further, it has a recess adjacent to the outside of one leg into which a square nut or metal disk 90 is inserted.

The bore holes 80 receive an adjusting screw 100, whose head 30 is sufficiently dimensioned and configured with respect to grip that it can be operated manually. The head 30 of the adjusting screw is arranged on the side of the clamping holder located opposite to a square nut or a metal disk 90. When the adjusting screw 100 is turned clockwise, i.e., in the closing direction, the head 30 carries the adjacent leg 20 along until a closed position has been reached. Near the aperture, the legs 10, 20 are shaped corresponding to an object 110 intended to be received, so that the object 110 is received between the legs 10, 20 with contact pressing force that is evenly distributed across the contacted surface of the object. The thread of the adjusting screw has a groove 40 whose dimension in the longitudinal direction is greater than the thickness of the metal disk 90. When the screw 100 is released from the thread of the metal disk 90 by turning it counterclockwise for opening, a first release occurs when the grooved portion 40 coincides with the bore hole of the metal disk 90. In this position of the adjusting screw 100, there is sufficient space such that, starting from a preferred position, the user can open the legs 10, 20 wider, since the adjusting screw 100 is not engaged in a thread and only rests loosely in it, so that leg 20 is movable. However, the threaded portion 120 of the adjusting screw 100 having the greatest distance from the head 30 of the adjusting screw 100 prevents a complete removal of the adjusting screw 100 from the metal disk 90 or the bore hole 80 of the block 50 arranged at the clamping holder provided there is no further deliberate turning of the adjusting screw 100. In this manner, the adjusting screw 100 is secured against an unexpected or unintentional release from the clamping holder.

Figure 3:
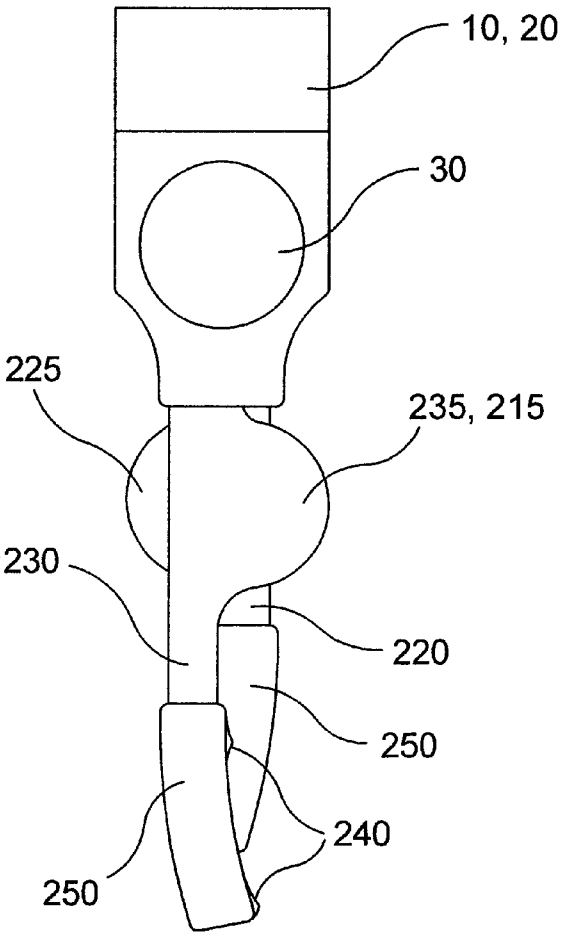
FIG. 3 shows a side view of the second clamping holder.
Figure 2:
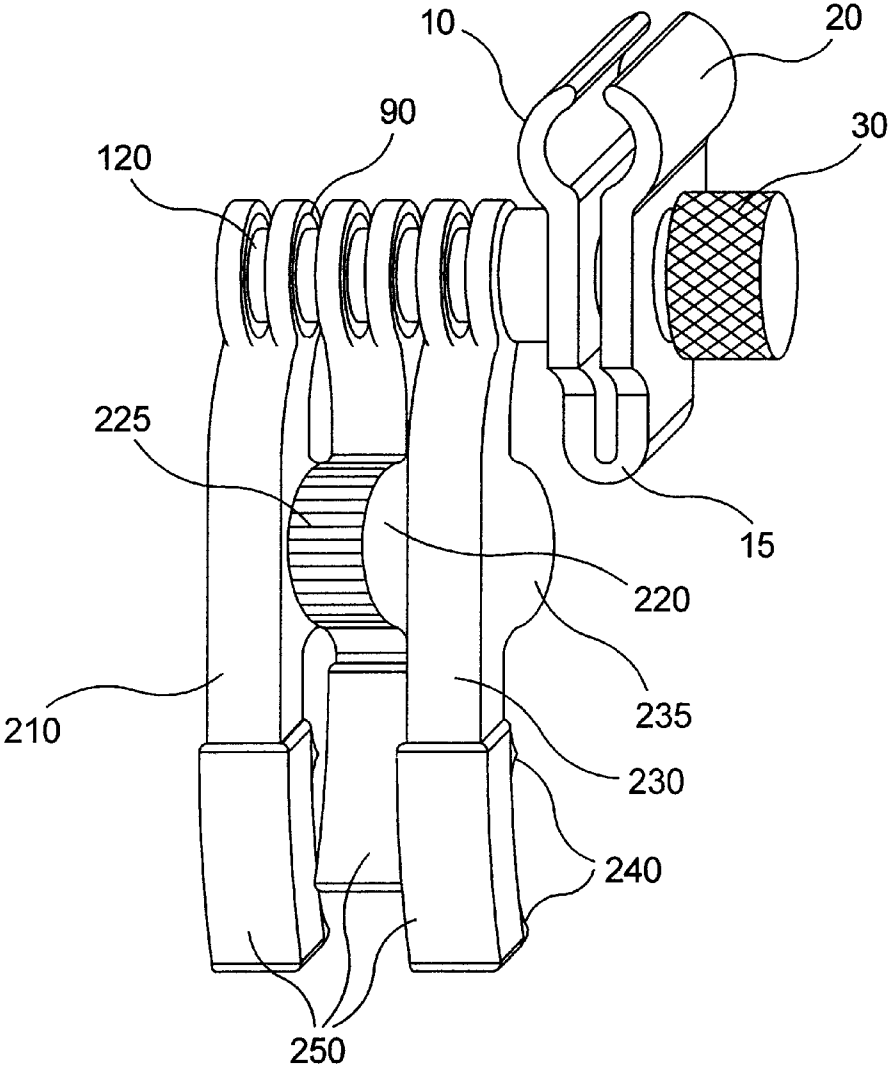
FIG. 2 shows a second clamping holder.

The clamping holder shown in FIGS. 2 and 3 is provided with a fastening device for clamping the clamping holder to a flat body, which fastening device is constructed as a one-piece plastic part. Onto the substantially cylindrical body 120 of the plastic part, there are formed, integral therewith, in a springing manner, three gripping fingers 210, 220, 230 alternatingly curved in slightly towards a center plane in a fashion similar to the index finger, thumb and middle finger of a hand, the gripping finger 220 that corresponds to the thumb being slightly shorter than the gripping fingers 210, 230 corresponding to the index finger and middle finger. The free ends of the gripping fingers 210, 220, 230 have two small raised portions 240 on one inner side. To protect the object from scratching, the free ends have been covered with a rubber skin 250. Halfway along the length of each of the gripping fingers 210, 220, 230, a press protrusion 215, 225, 235 is formed integral therewith at the inner side and is provided with a ribbed surface.

The gripping fingers 210, 220, 230 are especially suited for gripping the edge of a flat body, for example, the bell of a tuba, or for engaging around a rod. When a user pushes one of the press protrusions 215, 225, 235 towards the center plane with index finger, thumb and middle finger, respectively, the ends of the gripping fingers 210, 220, 230 are moved away from the center plane, so that, for example, the fastening device can be pushed onto the edge of the flat body. Letting go of the fastening device causes the flat body to be held between the gripping fingers 210, 220, 230.

Figure 4:
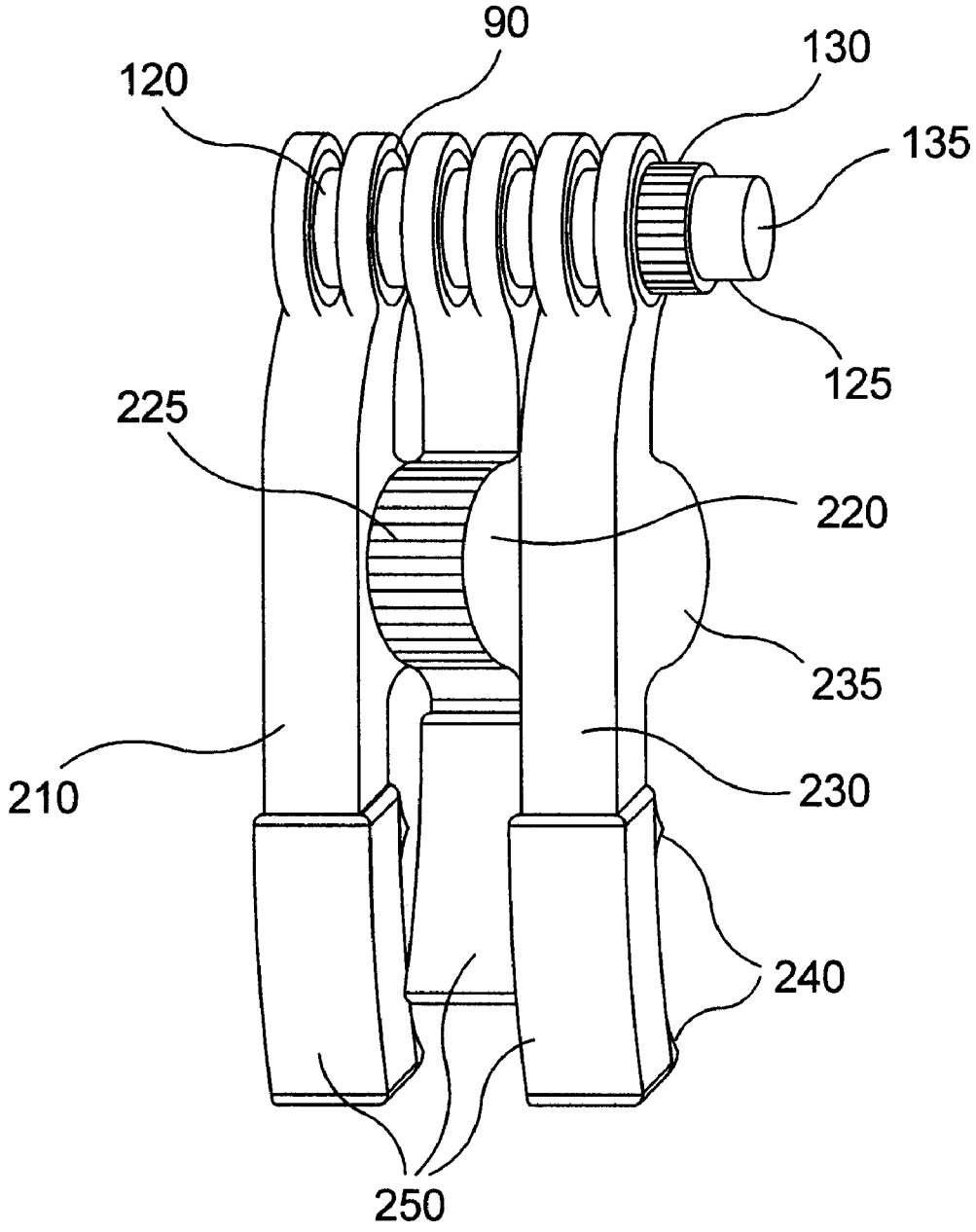
FIG. 4 shows a fastening device for the second clamping holder.

A projection 125 as an extension of the cylindrical body 120 is formed on integral with the cylindrical body 120 of the fastening device; its surface is ribbed 130 lengthwise (FIG. 4). A square nut 90 is inserted in a recess of the cylindrical body 120. The leg 10 of the clamping holder in contact with the fastening device is clamped onto the projection 125 by its bore hole so as to be rotatable. A ribbed profile in the bore hole in the leg (not shown) engages with the ribbing of the pin so that the leg 10 and clamping holder can be rotated in steps around the axis of the cylindrical body 120. The projection 125 and the cylindrical body 120 have a central bore hole 135 receiving the thread 100 of the adjusting screw 100, 30. When the adjusting screw 100, 30 is tightened, the clamping holder is closed and pressed firmly against the side of the cylindrical body 120 onto the projection 125 of the fastening device, so that it can not be improperly rotated. In this manner, the adjusting screw 100, 30 fulfills a dual function, as it not only clamps the object between the legs 10, 20 but also locks the alignment of the clamping holder.

While the foregoing description and drawings represent the preferred embodiments of the present invention, it will be obvious to those skilled in the art that various changes and modifications may be made therein without departing from the true spirit and scope of the present invention.

What is claimed is:

1. A clamping holder comprising:

an arrangement of a first leg and a second leg which are constructed in such a way that they can be moved towards one another;

adjusting means which act on at least one of the legs, activation of said adjusting means enabling a movement of the legs towards one another so that objects to be clamped can be locked in position;

means being provided that cancel the locking effect and hold the adjusting means at the clamping holder;

and wherein a fastening device is arranged at the clamping holder, and wherein the fastening device forms one piece and has three gripping fingers which are arranged on an axis and alternately slightly curved towards a center plane.

2. The clamping holder according to claim 1, wherein said means for canceling the locking effect comprise an adjusting screw having an external thread and a groove, wherein the adjusting screw engages in at least one thread of the clamping holder, and wherein the at least one thread of the clamping holder is arranged in one of the two legs or in a block adjoining the legs and is narrower in length than the groove.

3. The clamping holder according to claim 1, wherein the legs are connected in a springing manner as portions of a one-piece structural component part preferably made of injection-moldable plastic.

4. The clamping holder according to claim 1, wherein the clamping holder is suitable for receiving an arm of a microphone for musical instruments.

5. The clamping holder according to claim 1, wherein the adjusting means lock the clamping holder to the fastening device.

6. A clamping holder in accordance with claim 1 wherein said clamping holder can hold a microphone.

7. The clamping holder of claim 2 wherein the block takes the form of a square nut.

* * * * *